US012263978B2

(12) United States Patent
De Brunier

(10) Patent No.: US 12,263,978 B2
(45) Date of Patent: Apr. 1, 2025

(54) METHOD FOR BUNDLE-PACKAGING BATCHES OF PRODUCTS, HEATING DEVICE AND FACILITY WITH SUCH A DEVICE

(71) Applicant: SIDEL PACKING SOLUTIONS, Corcelles-les-Citeaux (FR)

(72) Inventor: François-Régis De Brunier, Corcelles-les-Citeaux (FR)

(73) Assignee: SIDEL PACKING SOLUTIONS, Corcelles-les-Citeaux (FR)

( * ) Notice: Subject to any disclaimer, the term of this patent is extended or adjusted under 35 U.S.C. 154(b) by 455 days.

(21) Appl. No.: 17/416,469

(22) PCT Filed: Dec. 19, 2019

(86) PCT No.: PCT/EP2019/086236

§ 371 (c)(1),
(2) Date: Jun. 19, 2021

(87) PCT Pub. No.: WO2020/127682

PCT Pub. Date: Jun. 25, 2020

(65) Prior Publication Data

US 2022/0063887 A1 Mar. 3, 2022

(30) Foreign Application Priority Data

Dec. 20, 2018 (FR) ..... 1873613

(51) Int. Cl.
*B65B 53/06* (2006.01)
*B65B 35/30* (2006.01)
(Continued)

(52) U.S. Cl.
CPC ..... *B65B 53/063* (2013.01); *B65B 35/30* (2013.01); *B65D 35/30* (2013.01); *B65D 71/08* (2013.01)

(58) Field of Classification Search
CPC ..... B65B 53/063; B65B 53/06; B65B 35/30; F26B 15/00; B65D 35/30; B65D 71/08; B05D 3/0413
See application file for complete search history.

(56) References Cited

U.S. PATENT DOCUMENTS 2,889,806 A * 6/1959 Conant ..... D21J 1/08 118/65
3,115,735 A * 12/1963 Harrison ..... B65B 53/063 53/557
(Continued)

FOREIGN PATENT DOCUMENTS

DE 102011054780 A1 * 4/2013 ..... B65B 53/063
EP 3351481 A1 7/2018
(Continued)

OTHER PUBLICATIONS

International Search Report dated Jan. 31, 2020 for PCT/EP2019/086236.
Chinese Office Action dated Jun. 17, 2022 for CN113242831.

*Primary Examiner* — Joshua E Rodden
(74) *Attorney, Agent, or Firm* — Blake T. Hudson

(57) ABSTRACT

The present invention relates to a method for bundle-packaging batches of products, wherein products are moved in a longitudinal running direction, grouped into batches and wrapped with a film of heat-shrinkable film. Each wrapped batch is heated to form a contraction of each sheet around said batch. Heating of a batch is performed by the circulation of at least one heated air stream and by the expulsion of said stream toward the interior of the enclosure of an oven provided, successively, with first and second sections; the sheet is cooled; during heating, along at least a part of the first section, a first air stream is shaped discontinuously and expelled toward the interior of said enclosure. The method consists, during heating, along said second section, in shap-
(Continued)

Figure 1:
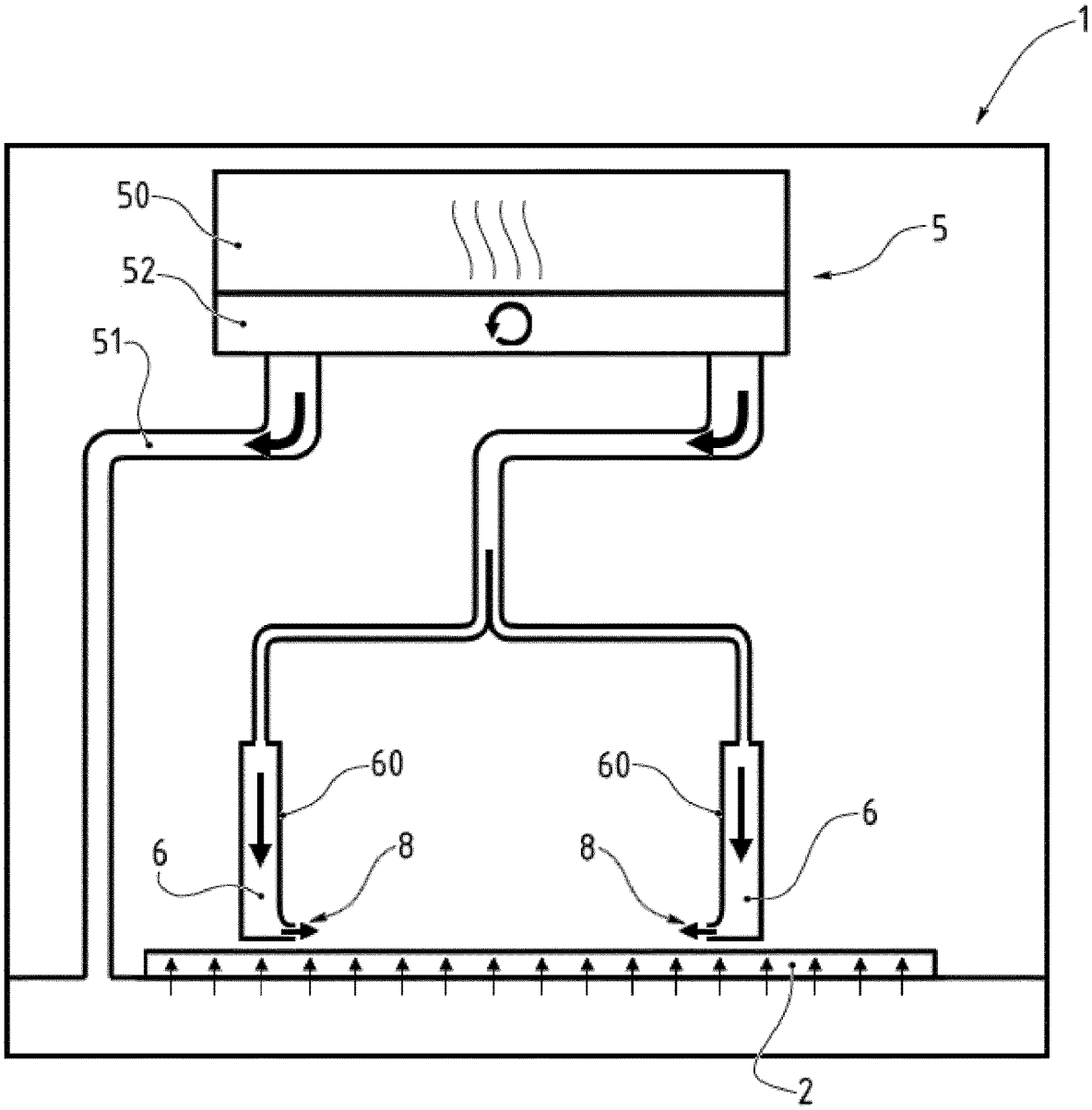

ing a second stream as an air knife and expelling said air knife toward said sheet to be smoothed.

8 Claims, 2 Drawing Sheets

(51) Int. Cl.
*B65D 35/30* (2006.01)
*B65D 71/08* (2006.01)

(56) References Cited

U.S. PATENT DOCUMENTS 3,123,955 A * 3/1964 Weissensee et al. ..... B65B 53/063 53/442
3,222,800 A * 12/1965 Siegel ..... B65B 53/063 392/382
3,572,004 A * 3/1971 Carmichael ..... B65B 53/063 53/48.6
3,668,817 A 6/1972 Bell
3,808,767 A 5/1974 Reid
3,897,671 A 8/1975 Higgins
4,336,279 A * 6/1982 Metzger ..... F26B 3/283 118/643
4,849,598 A * 7/1989 Nozaki ..... H05B 6/105 219/601
6,689,180 B1 * 2/2004 Liao ..... B65B 53/063 53/442
7,811,084 B2 * 10/2010 Huang ..... B29C 63/423 53/442
8,382,013 B2 * 2/2013 Pucciani ..... B05B 1/005 239/592
10,011,382 B2 * 7/2018 Schilling ..... B65B 53/063
11,377,247 B2 * 7/2022 Uetsuki ..... B65B 53/063
2018/0209740 A1 7/2018 Beesley et al.
2020/0317381 A1 * 10/2020 Choplin ..... B65B 53/063

FOREIGN PATENT DOCUMENTS

GB 996078 A * 6/1965
GB 2185958 A 8/1987

* cited by examiner

METHOD FOR BUNDLE-PACKAGING BATCHES OF PRODUCTS, HEATING DEVICE AND FACILITY WITH SUCH A DEVICE

BACKGROUND OF THE INVENTION

The present invention falls within the field of product packaging in a line for the production and processing of said products.

Such products can be, in a nonlimiting manner, containers, such as bottles, cans, cardboard brick packs, or even such containers individually or grouped together in boxes, cases, cardboard boxes or bundles.

As is known, in an industrial line, the products can receive multiple different successive treatments, ranging from the production of the container by a plastic injection-molding or stretch blow-molding operation, notably involving the filling, closure with a plug and labeling of the products individually, to the packaging in batches of multiple products grouped together.

Furthermore, each batch is constructed by grouping-together, staggered or not, multiple products according to a matrix arrangement, generally of overall square or rectangular parallelepipedal form. Complementing this, each batch can be secured at the base by means of a support forming a bottom, for example a cardboard-covered pack tray.

Once the products are grouped together in batches, each batch can be wrapped, in particular covered with a film in order to keep the products together and simplify the handling of such a batch.

BRIEF SUMMARY OF THE INVENTION

The invention targets the bundle-packaging of multiple products grouped together in batches.

Product bundling consists in grouping them together in batches then wrapping each batch of products by means of a sheet of a film of heat-shrinkable material. A wrapped batch then undergoes a heating step for the sheet to mold to the overall outer form of the batch. In short, the sheet of film is shrunk under the effect of the heat to apply a shrinkage ensuring the securing of the products grouped together as a batch.

The grouping-together in batches, the wrapping and the heating are performed by means of a dedicated device of pallet wrapping machine type, through multiple successive stations.

Further, the heating of a wrapped batch is performed by passing through an oven, of tunnel oven type. Each batch of products is transported on the top face of one or more conveyors, from the entry to the exit of said oven.

The same oven can comprise several distinct sections, abutting one after the other, each applying parameters dedicated to the heating of each batch passing through said oven. In particular, the heating is performed by heating means ensuring the circulation of heated air streams toward the interior of the sections of said oven; preferably, a heating means specific to each section.

On the one hand, the hot air is sent to the conveyor and allows the underside and the bottom edges of the batches transported on the conveyor to be heated, targeting essentially the part of the sheet of the film situated under the batch of products, notably in order to apply a weld to the ends of the wrapping sheet which, at the time of prior wrapping, are superposed and pressed against one another under the weight of the products of the batch. On the other hand, the hot air is sent toward the internal volume of the enclosure and allows the outside of the wrapped batch to be heated, in order to effect a contraction of the sheet of the film for a shrinkage to be pressed into contact with the products, by deforming the sheet for it to mold to a part of the contours.

Further, each heating means comprises a heating block whose function is to heat the air which passes through it. A heating means also comprises a means for circulating air heated by said heating block, in the form of a heated air stream. At the output, this heated air stream is sent to a circuit that divides and emerges, on the one hand, at the level of the conveyor of its section and, on the other hand, inside the volume of the enclosure of this same section.

In said latter case, toward the interior of the volume of the enclosure, the expulsion of the heated air at the output of the corresponding circuit is performed through manifolds. Preferably, at least two manifolds are disposed vertically and parallel to one another, extending longitudinally according to the direction of displacement of the batches, over a portion of length of each section. Two manifolds are spaced apart transversely by an interval, on the one hand, allowing the passage of the batches between said two manifolds and, on the other hand, at a determined distance with respect to the lateral walls of the batches, in order to ensure the heating and the shrinkage.

Further, each manifold has an overall rectangular or trapezoidal parallelepipedal form, that is hollow and closed. Each manifold is connected to the output of the circuit through which the heated air stream arrives and has a wall with orifices through which the hot air is expelled and directed toward the interior of the volume of its section. Such orifices are generally identical, having a circular section, and are also generally distributed regularly over the surface of the wall of each manifold.

A first issue with this expulsion of air through orifices lies in the differences in flow rates between the orifices situated closest to the output of the circuit emerging at a point of the manifold and those situated further away. This difference in flow rate generates a non-uniformity of the air stream coming into contact with the batches.

Another issue lies in the turbulences generated inside each manifold, which provokes a random expulsion of a part of the stream on either side of each orifice and not allowing the air to be directed straight, orthogonally with respect to each orifice.

Furthermore, the positioning of the orifices at regular intervals creates a discontinuity of the expelled air: the sheet of film receiving air when it passes opposite the orifices, then less is received upon its passage between said orifices.

In one case as in the other, this results in turbulences of the expelled air, without allowing its direction to be perfectly controlled.

One solution consists in positioning nozzles on each orifice, allowing the air expulsion trajectory to be straightened. Such a solution is expensive and only allows a part of the issue to be resolved.

Further, to apply the shrinkage, one major constraint lies in obtaining a perfectly smooth surface without folds. Indeed, during heating, the sheet of film first of all inflates, forming a bubble, to then shrink and grip the batch of products. Upon the expansion of this bubble, the moving air risks creating a fold which, once the sheet is constrained, forms a thermofused fold, which cannot subsequently be undone.

Less importantly, the moving air can form wrinkles. Such a wrinkle is not prejudicial to the securing of the batch, but does present an unesthetic appearance, distorting the illustration possibly present on the wrapped batch.

In one case as in the other, the constrained sheet is generally folded and wrinkled along the edges of each sheet, at two ends on either side of the batch, forming overall rounded openings, called "lunulas". Again, these folds, above all at the lunulas, present an esthetic appearance, but also make it difficult to tear off the jacket of a batch in order to extract the products.

The aim of the invention is to mitigate the drawbacks of the state of the art by proposing a bundle-packaging of batches of products that makes it possible to smooth the wrinkles present on the faces and at the lunulas upon the contraction of the sheet around said batches, while limiting the risks of creating wrinkles.

In particular, the invention provides, along a section, notably at the end of heating (namely at the last section of the oven), a mode of expulsion of the heated air that notably results in an increased blowing pressure and a controlled orientation of the expelled stream, ensuring a uniformity of the heated air expelled continuously along said section.

For this, the invention envisages creating a stream having a laminar flow extending substantially longitudinally with respect to the section. Such a laminar stream notably makes it possible to precisely control the expelled air flow rate, regularly and continuously along said section.

To this end, the invention relates to a method for bundle-packaging batches of products, wherein at least:

products are displaced in a longitudinal running direction;

products are grouped together in batches;

each batch is wrapped with a sheet of heat-shrinkable film;

each wrapped batch is heated so as to form a contraction of each sheet around said batch, the heating of a batch being performed by the circulation of at least one heated air stream and by the expulsion of said stream toward the interior of the enclosure of an oven provided, in succession, with at least one first section and one second section;

the sheet of each batch is cooled;

during heating, along at least a part of said first section, a first air stream is shaped discontinuously and said first discontinuous stream is expelled toward the interior of said enclosure, such that said sheet molds to the corresponding batch.

Such a method is characterized in that it consists at least, during heating, along said second section, in shaping a second stream as an air knife and expelling said air knife toward said sheet to be smoothed.

According to additional, nonlimiting features, said second stream can be shaped continuously.

Said air knife can be oriented transversely with respect to the batch to be heated and to said longitudinal direction, preferably orthogonally.

Said air knife can be oriented parallel or inclined with respect to the plane containing said longitudinal running direction.

The expulsion pressure of said air knife can be increased with respect to the circulation pressure of said second stream.

Said air knife can be displaced vertically, with respect to the dimensions of each batch.

The invention also relates to a device for bundle-packaging batches of products, comprising at least:

an oven provided with at least one first section and one second section;

at least one conveyor passing through said first and second sections;

means for heating the first and second sections;

the heating means comprising at least one heating block, at least one circuit linking said heating block and emerging inside said corresponding section, and at least one means for circulating an air stream heated by said heating block to said circuit;

for each first and second section, each heating means comprising at least one manifold linked at the output of at least said circuit, each manifold extending along at least a part of a corresponding section.

Such a device is characterized in that:

each manifold of said first section comprises at least one wall provided with orifices distributed over the surface of said wall;

each manifold of said second section comprises at least one wall provided with at least one aperture extending longitudinally.

According to additional, nonlimiting features, each aperture can extend in the bottom part of said wall and is oriented transversely with respect to the surface of said wall.

Each aperture can extend horizontally or be inclined.

Each aperture can have a height less than the width of the corresponding manifold.

The invention relates also to an installation for bundle-packaging batches of products, comprising, in succession, at least:

one station for grouping said products into batches;

one station for wrapping each of said batches with a sheet of heat-shrinkable film;

one station for heating each sheet wrapping each batch;

one station for cooling the sheet of each batch;

characterized in that said heating station comprises a device for heating batches of products wrapped according to the invention.

Thus, the invention makes it possible to obtain the application of a shrinkage to a sheet wrapping a batch of products with a perfectly smooth appearance, reducing the risks of the formation of folds, wrinkles, small wrinkles, or other such wrinkles, notably enhancing its esthetic appearance.

BRIEF DESCRIPTION OF THE SEVERAL VIEWS OF THE DRAWING(S)

Figure 2:
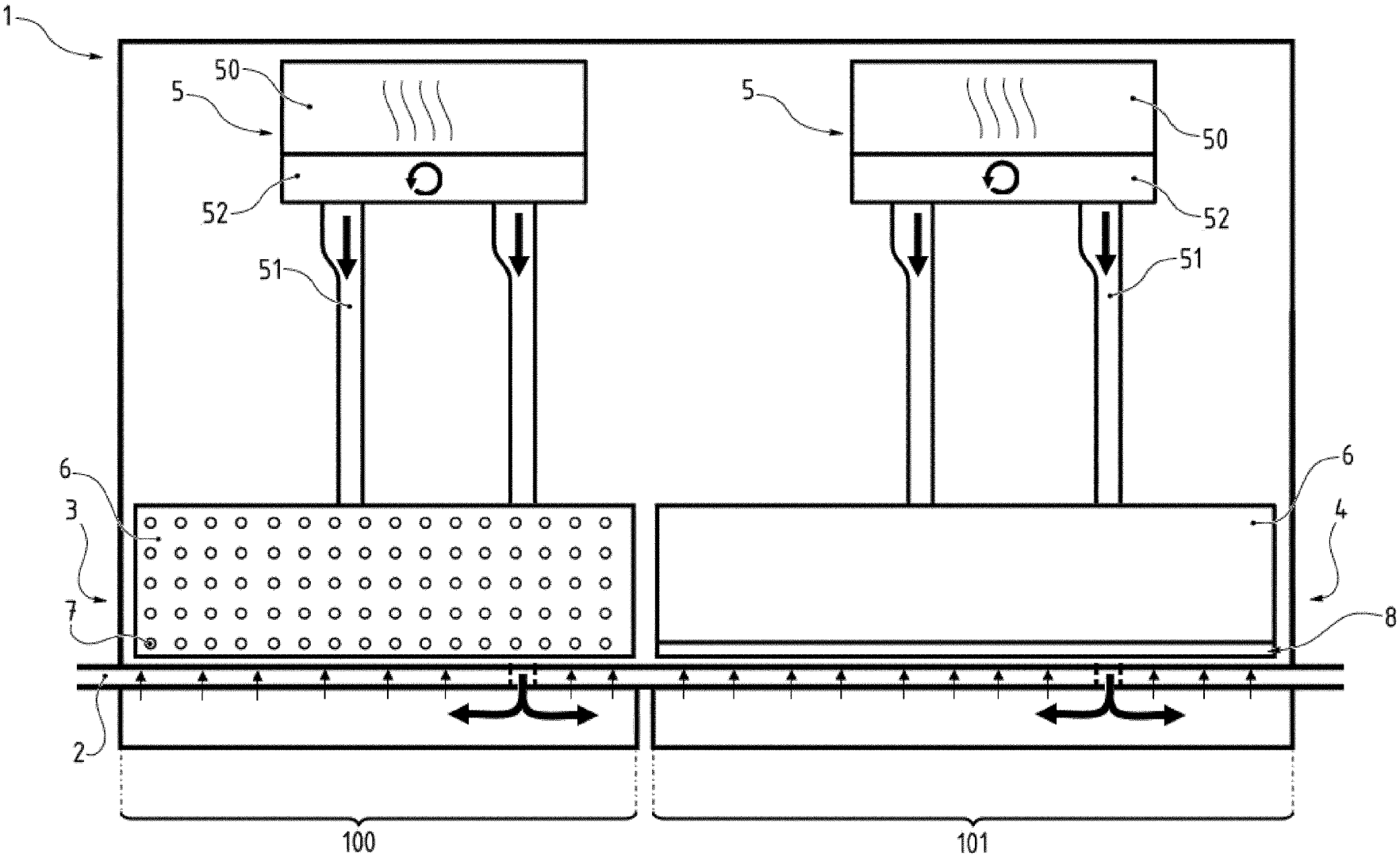

Other features and advantages of the invention will emerge from the following detailed description of the nonlimiting embodiments of the invention, with reference to the attached figures, in which:

FIG. 1 schematically represents a simplified view in transverse vertical cross section of a section of oven of an embodiment of the bundle-packaging device; and FIG. 2 schematically represents a simplified view in longitudinal vertical cross section of an oven with two sections according to another embodiment of said device, notably showing one of said sections equipped with a laminar heating.

DETAILED DESCRIPTION OF THE INVENTION

The present invention relates to product packaging.

Such products can be, in a nonlimiting manner, containers, such as bottles, cans, cardboard brick packs, or even such containers individually or grouped together in boxes, cases, cardboard boxes or bundles.

The invention particularly targets the bundle-packaging of said products.

As discussed previously, the bundling comprises multiple product-processing steps, namely, notably, the grouping-together of several products into batches, followed by a wrapping of each batch by means of a sheet of a film made of heat-shrinkable plastic material, then a step of heating of each wrapped batch in order, on the one hand, to ensure the welding of said sheet under said batch of products and, on the other hand, the contraction of the sheet to apply a shrinkage around the batch. Finally, a cooling step sets the wrapping before its handling and transportation, notably by palletization.

To this end, the invention relates to an installation for bundle-packaging batches of products, comprising, in succession, at least the stations concerned, namely a station for grouping said products into batches, a station for wrapping each of said batches with a sheet of heat-shrinkable film, followed by a station for heating each sheet wrapping each batch to apply a shrinkage and, finally, a station for cooling the sheet constrained externally on each batch.

Several of these stations can be envisaged, aligned in the longitudinal direction of transportation of the products and/or parallel.

In this context, the invention relates to a method for bundle-packaging batches of products. During such a method, products are displaced in a longitudinal running direction, the products are grouped together in batches, each batch is wrapped with a sheet of heat-shrinkable film, each wrapped batch is heated so as to apply a shrinkage of each sheet around said batch. Furthermore, once the shrinkage has been applied to each batch, the constrained sheet is cooled.

The invention targets more particularly the heating of a batch of products already grouped together and wrapped. Said heating station of the installation therefore comprises a device 1 for heating wrapped product batches.

The method can be partly applied within the device 1, which therefore constitutes a processing station of the installation, cooperating with other stations.

Such a device 1 comprises an oven.

In order to work the displacement of the products, within the device 1, but above all through said oven, the latter is provided with at least one conveyor 2. Preferably, a single conveyor 2 extends along the device 1, through and between the different stations. However, the oven can comprise at least its conveyor 2 which is specific to it. Consequently, the products are displaced in a longitudinal running direction along and within the installation, the device 1 and its oven.

Such a conveyor 2 comprises a structure and materials capable of withstanding the mechanical, and above all thermal, stresses. Said conveyor 2 can be of endless belt type, equipped with chain or a mat essentially made of metallic materials, notably of metal lattice type, or heat-resistant plastics. The batches of products are displaced on the top face of the conveyor 2.

The oven can be of any type, but preferentially of tunnel type. It comprises an entry 3 supplied with products by at least one wrapping station situated upstream and an exit 4, supplying batches of products to at least one cooling station situated downstream. Consequently, one or more conveyors 2 allow the products to be routed from the entry 3 to the exit 4, by allowing them to pass inside said oven, along a go path or strand.

Generally, the return path or strand of the conveyor 2 takes place outside of the oven, preferentially below or in the bottom part of said oven. The device 1 can comprise connected means dedicated to the cooling of the return path or strand of the conveyor 2, notably in order to reduce its temperature.

The oven comprises at least one first section 100 and one second section 101. The sections 100, 101 are abutted one after the other, ensuring a continuity of the internal volume of said oven. The sections 100, 101 are generally aligned, forming one and the same enclosure of said oven, extending longitudinally, in the direction of advance of the batches of products transported by the at least one conveyor 2.

According to the embodiment that can be seen in FIG. 2, the device 1 comprises two sections 100, 101, the oven consisting of each of them.

According to another embodiment, the device 1 can comprise more sections, the section 101 necessarily following the first section 100, the section 101 being preferentially the last section with respect to the direction of displacement of the batches.

According to the embodiments, the sections 100, 101 can have the same lengths or different lengths.

To this end, with the at least one conveyor 2 extending through the oven and the device 1, it logically extends along the sections 100, 101 of which it is composed. Notably, said conveyor 2 passes through at least one section 100, 101.

In the exemplary embodiment represented in FIG. 2, said oven comprises a first section 100 extending from the entry 3, followed by a second section 101, abutted to and extending from said first section 100 to the exit 4.

Each section 100, 101 determines a heating zone with specific parameters, corresponding to different steps of heating of each batch.

For this, the device 1 comprises heating means 5 for each section 100, 101. Each heating means 5 makes it possible to heat and send to the interior of the oven at least one heated air stream, preferably streams to the first section 100 and second section 101. Each heating means 5 can be dedicated to a section 100, 101, or even partially shared, notably having one or more common components.

The heating means 5 comprise at least one heating block 50, at least one circuit 51 linking said heating block 50 and emerging inside said corresponding section 100, 101, and at least one means 52 for circulating an air stream heated by said heating block 50 to said circuit 51. Thus, the air is heated by passing through the heating block 50, which is notably in the form of electrical resistors or a gas burner. Under the action of the circulation means 52, such as one or more fans, the heated air stream is sent to one or more circuits 51, notably in the forms of pipes or ducts.

In short, according to the method, the heating of a batch is performed by the circulation of at least one heated air stream and by the expulsion of said stream to the interior of the enclosure of the oven provided, in succession, with at least the first section 100 and the second section 101.

Furthermore, for each section 100, 101, at least one circuit 51 can emerge at the conveyor 2, notably across said conveyor 2 from bottom to top, allowing an air stream to be expelled toward the underside of the batches of products, in order to do the welding and apply at least a part of the shrinkage, namely at least a start of contraction of the sheet. One or more other circuits 51 can emerge directly inside the enclosure of the oven, notably inside each section 100, 101, the enclosure consisting of their internal volume.

To this end, for each first section 100 and second section 101, each heating means 5 comprises at least one manifold 6, notably several manifolds 6. Each manifold 6 extends along at least a part of a corresponding section 100, 101, preferably along most of the length of each section 100, 101.

Each manifold 6 can extend vertically or substantially vertically, namely notably orthogonally with respect to the plane containing said conveyor 2.

According to one embodiment, as can be seen in FIG. 2, the manifolds 6 are components positioned inside the enclosure of the corresponding section 100, 101.

According to another embodiment, not represented, the manifolds 6 can be formed by all or part of the lateral walls forming the enclosure of one or more of the sections 100, 101 of the oven of the device 1.

Preferably, two manifolds 6 are spaced apart transversely, with respect to the direction of longitudinal displacement of the batches, by an interval dependent on the dimensions of batches of products and on the dimensions of the sheets wrapping said batches to be heated and by a distance provided between the batch and the internal walls 60 of said two manifolds 6, said distance being arranged in order to allow the circulation of the expelled air inside the enclosure.

According to the embodiment that can be seen in FIG. 1, each section 100, 101 comprises a pair of manifolds 6. The internal walls 60 through which the air stream is expelled are turned toward the interior, facing one another, with the batches circulating between these internal walls 60.

According to another embodiment, each section 100, 101 can comprise three manifolds 6, and the internal walls 60 of the manifolds 6 situated on the sides are turned toward each internal wall 60 of a central manifold. The heated air stream is then expelled by each of the internal walls 60 of the central manifold.

To this end, each manifold 6 is linked at the output of at least said circuit 51. A manifold 6 can have a hollow and closed form, apart from an open link at the output of the circuit 51 and at its internal wall or walls 60 through which the air stream is expelled toward the interior of the enclosure of the corresponding section 100, 101.

According to other embodiments, each section 100, 101 can comprise more manifolds 6, arranged in pairs and/or with one or more central manifolds.

According to other embodiments, each manifold 6 of each section 100, 101 can be arranged as a central manifold.

A manifold 6 can have an overall parallelepipedal form, preferably rectangular, even trapezoidal.

According to one embodiment, as represented in the figures, each manifold 6 is linked to the corresponding circuit 51 at the top, connected at the top face.

Furthermore, each manifold 6 or each group of manifolds 6 of one and the same second section 101 can be displaced vertically, allowing its height to be adjusted with respect to the sizes of the batches of products to be heated. Each manifold 6 can also be displaced transversely, namely horizontally, modifying the interval between the internal walls 60 facing one another, by increasing or reducing the separating distance, depending on the dimensions of the products and of the batches to be heated circulating between said internal walls 60 of the manifolds 6.

Advantageously, the invention provides for the step in the heating applied in the first section 100 to be differentiated with respect to the step in the heating performed in the second section 101. In particular, the invention envisages modifying the way in which the air is expelled in the second section 101, in order to improve the application of the shrinkage on each batch. Furthermore, the second section 101 allows the sheet of film to come against the products of each batch, uniformly, as well as the ends of the sheet at each lunula, offering a new "bubbling" of the sheet and by smoothing its appearance to limit the appearance of wrinkles, while conferring a uniformity on the air streams expelled by each manifold 6.

For this, first of all, in the first section 100, a first step in the heating is carried out, notably allowing for a first bubbling followed by the contraction of the sheet of film which will form the lunulas on either side of the corresponding batch. Along at least a part of said first section 100, a first air stream is shaped discontinuously and said first discontinuous stream is expelled toward the interior of said enclosure, such that said sheet molds to the outline of the corresponding batch. The discontinuous nature is conferred on the air stream when it is expelled by each manifold 6, in particular when it passes through the corresponding internal wall 60.

According to one embodiment, as can be seen in FIG. 2, each manifold 6 of said first section 100 comprises at least one internal wall 60 provided with orifices 7 distributed over the surface of said internal wall 60.

The surface of an internal wall 60 is understood to mean its geometrical surface, extending by a lengthwise dimension and a heightwise dimension, forming a plate.

Consequently, the orifices 7 are formed over most of the plate of the internal wall 60. The orifices 7 can be spaced apart from one another, vertically and horizontally, notably forming columns and rows. The orifices 7 can be distributed regularly or not, spaced apart from one another by intervals that are equivalent or not.

Further, the orifices 7 are one-off, in that they form a multitude of points of expulsion of each first air stream of the first section to the interior of said first section 100.

Furthermore, at least one orifice 7 can comprise a nozzle or a channel, in order to orient or channel the expelled air. Several orifices 7 can be equipped with nozzles or channels, notably the orifices 7 of a row and/or of a column.

Thus, once expelled through the orifices 7 of the manifolds 6, the moving air is uniform, having an overall turbulent nature of flow, allowing this air to be blown for it to arrive at approximately all the points of the interior of the enclosure in a way that is oriented toward the batches to be heated.

Following this first step in the heating, to form the first bubble and by contraction apply the sheet of film against each batch, the invention provides a second step in the heating of the sheet of each batch, this second step in the heating aiming to be different and distinct. In a nonlimiting manner, this second step in the heating makes it possible to smooth the constrained sheet of each batch. In particular, the air expelled in this second step in the heating is more uniform, directed into a determined zone of the enclosure, so as to obtain a controlled expulsion of air in this zone.

For this, the invention provides, along said second section 101, for a second stream to be shaped as an air knife. The stream of such an air knife can have an essentially laminar flow, all of the fluid of which the expelled air is composed flowing more or less in the same direction, without the local differences opposing one another, thus dispensing with a turbulent regime, comprised of vortexes mutually opposing one another.

Preferentially, the second stream of the second section 101 emerging at each manifold 6 can be shaped continuously, contrary to the discontinuity of the first stream ejected through the orifices 7 of the manifolds 6 of the first section 100.

For this, each manifold 6 of said second section 101 comprises at least one wall provided with at least one aperture 8 extending longitudinally. In other words, said aperture 8 extends in the direction of displacement of the batches of products by the conveyor 2.

According to one embodiment, an aperture 8 can have a nose-shaped section, as can be seen in the vertical transverse cross section of FIG. 1. Such a nose is like an elbow, directed inward. Furthermore, the elbow of one manifold 6 faces the elbow of the manifold 6 situated opposite, blowing their respective air knife toward one another, toward each batch to be heated passing between these manifolds 6.

According to a particular embodiment, the aperture 8 can have a maximum height of fifty millimeters (50 mm), preferably a maximum height of less than 40 mm. This maximum dimensioning can make it possible to conserve the laminar flow aspect of the air knife, limiting the risks of turbulence upon the expulsion of the stream originating from the interior of the corresponding manifold 6.

Furthermore, an aperture 8 can extend horizontally, substantially parallel to the plane containing said conveyor 2. This horizontal disposition extends along a part of the aperture 8, preferably along the entire aperture 8.

Alternatively, an aperture 8 can be inclined with respect to a horizontal plane. An aperture 8 therefore has at least one slope increasing or rising vertically (or, conversely, decreasing and descending) over all or part of its length. Several slopes can be formed along one and the same aperture 8, for example increasing then decreasing.

According to one embodiment, an aperture 8 can have a corrugation, like a wave.

The apertures 8 of the manifolds 6 can be identical or symmetrical with respect to a vertical longitudinal central plane, said apertures 8 having the same forms and extending according to the same configuration.

Preferably, each aperture 8 can be continuous, namely its top and bottom walls delimit a space without obstacle from one end to the other. Furthermore, minor elements, such as plates or thin metal sheets, can serve as a link between said top and bottom walls of an aperture 8, in order to ensure its rigidity and its mechanical strength, without considerably modifying the continuous nature of expulsion in air-knife form of the second stream from the corresponding manifold 6.

According to another embodiment, each aperture 8 can be discontinuous, having several separate segments.

According to another configuration, the apertures 8 of the manifolds 6 can be different, shaped asymmetrically with respect to said vertical longitudinal central plane, creating expelled-air knives oriented differently on either side of each batch to be heated.

To this end, once each second stream is shaped as an air knife, it is expelled via the corresponding aperture 8 toward the sheet to be smoothed. It will be noted, as explained previously, that, at this stage, after the first step in the heating, the contraction of the sheet is already at least partly formed. The different second step in the heating makes it possible to apply different heating conditions, in order to improve the application of the shrinkage and the contraction of the sheet, in particular its wrinkle-free smoothing.

According to one configuration, said air knife can be oriented transversely with respect to the sheet to be heated and to said longitudinal direction. Preferably, said air knife can be oriented orthogonally, even substantially orthogonally. The air knife is then expelled directly, straight, toward the batches circulating inside the enclosure of the device 1.

According to another configuration, said knife can be oriented transversely in an inclined manner. The air knife is still expelled toward the interior of the enclosure of the second section 101, but upward or downward.

Independently, or in combination, said air knife can be oriented parallel with respect to the plane containing said longitudinal running direction. In other words, the air knife is expelled parallel to the conveyor 2, notably horizontally if the conveyor 2 is horizontal.

According to another configuration, said air knife can be oriented in an inclined manner with respect to the plane containing said longitudinal running direction. The air knife is then expelled according to at least one increasing or decreasing slope, even several successive increasing and decreasing slopes, or vice versa, with respect to the running direction. Thus, during the heating of each batch, its advance allows the air knife to sweep the height of each batch and distribute the heating, improving the smoothing of the constrained sheet at precise points of the height of the heated batch.

According to yet another configuration, the air knife can be expelled with one or more slopes and portions that are parallel, notably horizontal, between said slopes. The knife can be expelled through an aperture 8 that is straight or shaped in a rounded fashion, in the form of a circular arc, even as a corrugation, such as a wave.

According to one embodiment, the manifolds 6 can be displaced vertically in order to modify the height of expulsion of the air knife with respect to each batch to be heated. Such displacement can be performed at the time of passage of each batch, in order for the air knife to be able to sweep the height of said batch to be heated.

Further, such a displacement of the air knife can be performed with respect to the dimensions of each batch to be heated. Each manifold 6 is then displaced vertically, in particular upon a change of size of products and batches to be heated.

The different possible configurations can be obtained by shaping the form of the aperture 8 in a dedicated manner. The aperture 8 is therefore oriented transversely with respect to the surface of said internal wall 60, in order to expel the air knife toward the interior. The aperture 8 can be inclined or straight, with segments parallel to the plane of the conveyor 2, notably horizontal segments over all or part of its length, and/or segments that are inclined angularly in longitudinally ascending and/or descending manner, even inclined upward or downward with respect to a transverse horizontal plane.

Moreover, according to one embodiment, as can be seen in FIG. 1, each aperture 8 extends in the bottom part of said internal wall 60 of the corresponding manifold 6. This positioning makes it possible to reduce the turbulences inside each manifold 6, before the expulsion of the second stream through the aperture 8 which then shapes it more efficiently as a uniform air knife.

According to another embodiment, not represented, one and the same manifold 6 can comprise several apertures 8, then creating several air knives expelled toward the interior of the enclosure. Each aperture 8 and the knife which passes through it can have a specific and dedicated configuration, different from the other aperture 8 and from the corresponding expelled air knife. As an example, two apertures 8 can extend parallel to one another, one on top of the other, following the same straights, curves and/or slopes. Conversely, two apertures 8 of one and the same manifold 6 can have non-parallel segments, notably with different inclinations.

According to one configuration, the expulsion pressure of said air knife can be increased with respect to the circulation pressure of said second stream. For this, in particular, each aperture 8 can have a height less than the width of the corresponding manifold 6. The air stream is then compressed upon its passage through the aperture 8, because of the narrowing of said aperture 8, which accelerates the expelled stream, increasing the pressure of the expelled air knife and improving the laminar aspect of the flow, notably by a Venturi effect.

As emerges from the above, the oven can comprise, in succession, along the longitudinal running direction, at least one first section 100 and one second section 101. Thus, the products pass first of all into the first section 100, then into the second section 101

Each section 100, 101 comprises at least one manifold 6 intended to expel the heated air stream toward the interior of the enclosure of the oven.

Preferably, the packaging method is a method for bundle-packaging batches of products, wherein at least:

products are displaced in a longitudinal running direction;

products are grouped together in batches;

each batch is wrapped with a sheet of heat-shrinkable film;

each wrapped batch is heated so as to form a contraction of each sheet around said batch, the heating of a batch being performed by the circulation of at least one heated air stream and by the expulsion of said stream toward the interior of the enclosure of an oven provided, in succession, along the longitudinal running direction, with at least one first section (100) and one second section (101) through, for each section (100, 101), at least one manifold (6);

the sheet of each batch is cooled;

when heating, along at least a part of said first section (100), a first air stream is shaped discontinuously and said first discontinuous stream is expelled toward the interior of said enclosure, such that said sheet molds to the corresponding batch; the discontinuous nature being conferred on the air stream when it is expelled through each manifold (6), each manifold (6) of said first section (10) comprising at least one wall provided with orifices (7) distributed over the surface of said wall;

This method is preferably characterized in that it consists at least:

when heating, along said second section (101), in shaping a second stream as an air knife and expelling said air knife toward said sheet to be smoothed, said second stream being shaped continuously, by the fact that each manifold of said second section (101) comprises at least one wall provided with at least one aperture (8) extending longitudinally.

Thus, the invention makes it possible, through the change of heating between the first section 100 with a turbulent stream and the second section 101 with a stream shaped as an air knife, to improve the smoothing of the sheet of batches thus heated.

The invention claimed is:

1. A device for heating coated batches of products, comprising at least:

an oven provided with at least one first section and one second section;

at least one conveyor passing through said first and second section;

heating means for heating the first and second sections;

the heating means comprising at least one heating block, at least one circuit linking said heating block and emerging inside said corresponding one of said first and second sections, and at least one circulation means for circulating an air stream heated by said heating block to said circuit;

at least one manifold for each of the first and second sections, the manifolds linked at the output of the at least one circuit of the heating means and extending along at least a portion of the corresponding one of said first and second sections;

wherein:

each manifold of said first section comprises at least one wall provided with orifices distributed over a surface of said wall;

each manifold of said second section comprises at least one wall provided with at least one aperture extending longitudinally in a direction of displacement of the batches of products by the conveyor, the at least one aperture comprising a length that is at least two times a width thereof.

2. The device as claimed claim 1, wherein each aperture extends in a bottom part of said wall and is oriented transversely with respect to the surface of said wall.

3. The device as claimed claim 1, wherein each aperture extends horizontally or is inclined.

4. The device as claimed in claim 1, wherein each aperture has a height less than a width of the corresponding manifold.

5. An installation for bundle-packaging batches of products, comprising:

one station for grouping said products into batches;

one station for wrapping each of said batches with a sheet of heat-shrinkable film;

one station for heating each sheet wrapping each batch;

one station for cooling the sheet of each batch;

wherein said heating station comprises the device for heating batches of wrapped products as claimed in claim 1.

6. The device as claimed in claim 2, wherein each aperture extends horizontally or is inclined.

7. The device as claimed in claim 2, wherein each aperture has a height less than a width of the corresponding manifold.

8. A device for heating coated batches of products, comprising at least:

an oven provided with at least one first section and one second section;

at least one conveyor passing through said first and second section, the conveyor defining a conveyor plane, the conveyor plane being generally planar with the conveyor and generally extending therealong through the first and second sections;

heating means for heating the first and second sections;

the heating means comprising at least one heating block, at least one circuit linking said heating block and emerging inside said corresponding one of said first and second sections, and at least one circulation means for circulating an air stream heated by said heating block to said circuit;

at least one manifold for each of the first and second sections, the manifolds linked at the output of the at least one circuit of the heating means and extending along at least a portion of the corresponding one of said first and second sections;

wherein:

each manifold of said first section comprises at least one wall provided with orifices distributed over a surface of said wall;

each manifold of said second section comprises at least one wall provided with at least one aperture extending longitudinally in a direction of displacement of the batches of products by the conveyor, the at least one aperture comprising a longitudinal length that is at least partially greater than its respective width thereof.

* * * * *